United States Patent [19]

Kojima

[11] 3,989,445

[45] Nov. 2, 1976

[54] PENCIL TYPE GAS LIGHTER

[75] Inventor: Mitsuo Kojima, Ichikawa, Japan

[73] Assignee: Kojima Precision Parts Co., Ltd., Japan

[22] Filed: July 21, 1975

[21] Appl. No.: 597,328

[30] Foreign Application Priority Data

| | | |
|---|---|---|
| Aug. 19, 1974 | Japan | 49-94242 |
| Feb. 22, 1975 | Japan | 50-24479 |
| Feb. 22, 1975 | Japan | 50-24478 |
| Mar. 22, 1975 | Japan | 50-38663 |
| Mar. 22, 1975 | Japan | 50-38664 |
| Mar. 23, 1975 | Japan | 50-38554 |
| Mar. 23, 1975 | Japan | 50-38555 |

[52] U.S. Cl. ..... 431/256; 431/266; 431/344

[51] Int. Cl.[2] ..... F23Q 2/28

[58] Field of Search ..... 431/255, 254, 266, 344; 317/81, DIG. 11

[56] References Cited

UNITED STATES PATENTS

| | | | |
|---|---|---|---|
| 3,425,783 | 2/1969 | Goto | 431/255 |
| 3,820,941 | 6/1974 | Piffath et al. | 431/254 |
| 3,826,952 | 7/1974 | Obata et al. | 317/81 |
| 3,891,381 | 6/1975 | Moriya | 431/255 |

*Primary Examiner*—Edward G. Favors
*Attorney, Agent, or Firm*—George B. Oujevolk

[57] ABSTRACT

A pencil type gas lighter comprising a cylindrical casing consisting of a fore cylinder provided with a flame port at the front end and a rear cylinder separately joined with said fore cylinder. A gas container in said fore cylinder housing has an ignition nozzle with a gas valve disposed on the fore cylinder front end side of said gas container in communication with said gas container through said gas valve. A discharge electrode is positioned within the range of gas ejection from the ignition nozzle, and a feed valve is disposed on the fore cylinder rear end side of said gas container for supplying gas into said gas container. A high voltage generating means in said rear cylinder is electrically connected to said discharge electrode, said high voltage generating means having a valve opening member and a lever, the valve opening member being adapted for opening the gas valve in cooperation with the lever operable to generate a high voltage in said high voltage generating means.

15 Claims, 31 Drawing Figures

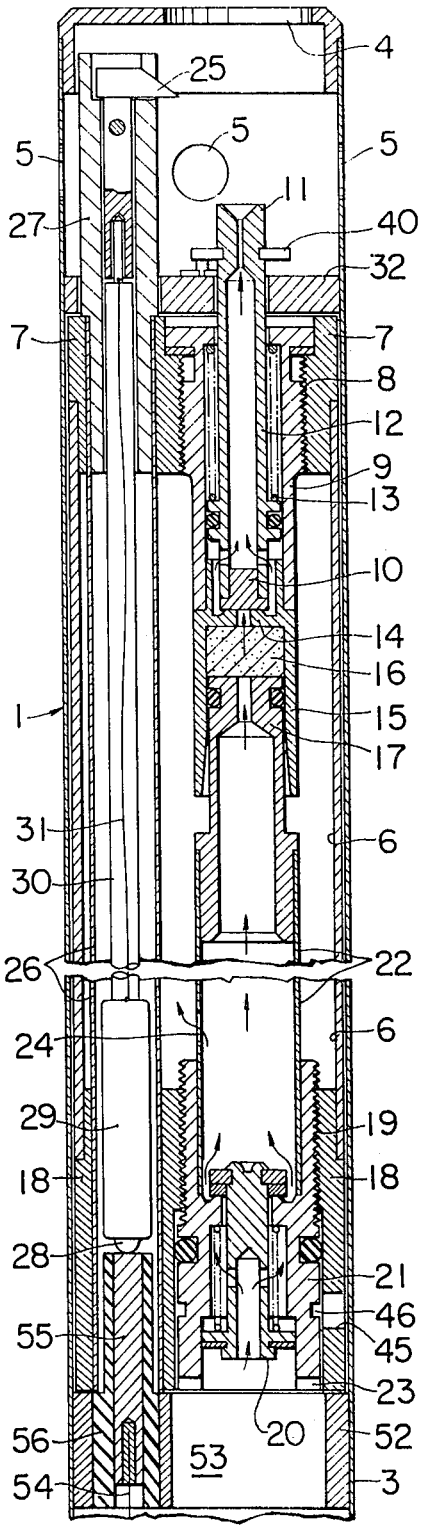
FIG. 6
FIG. 7
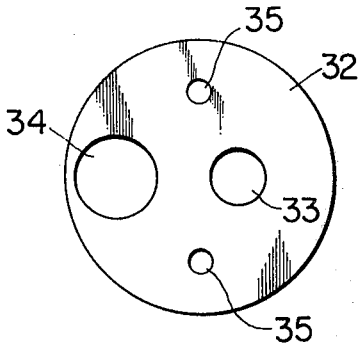
FIG. 8
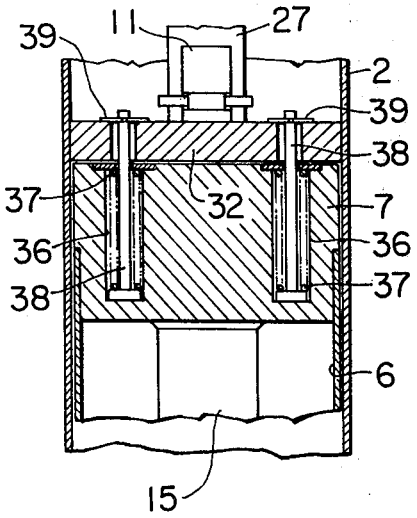

FIG. 30
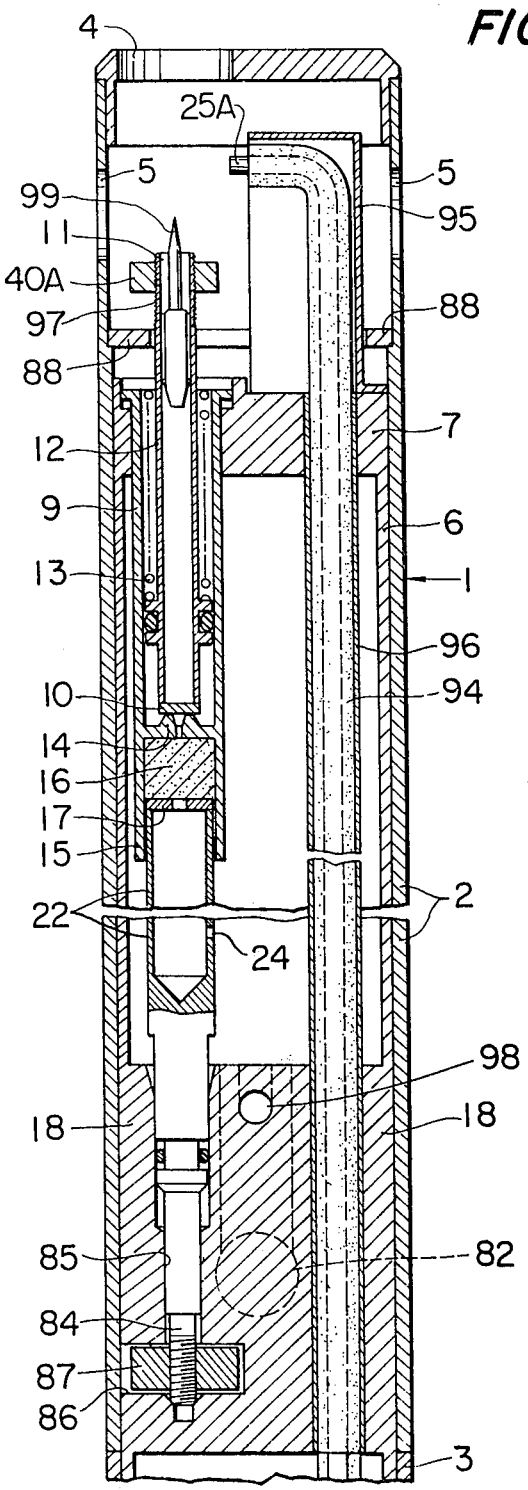
FIG. 29
FIG. 31
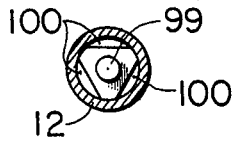

PENCIL TYPE GAS LIGHTER

BACKGROUND OF THE INVENTION

This invention relates to a gas lighter having the appearance of a pencil.

BRIEF DESCRIPTION OF THE PRIOR ART

Most of the conventional pencil-shaped gas lighters use a casing which is formed from a single elongated cylindrical body and which houses in its forward portion a gas container, an ignition nozzle which communicates with said gas container through a gas valve and a discharge electrode disposed within the range of gas ejection from the ignition nozzle and also houses in its rearward portion a high voltage generating means electrically connected to the discharge electrode.

One of the important problems in making such pencil-shaped gas lighters is selection of the position where the feed valve for supplying gas into the gas container is provided.

If it is attempted to set the feed valve directly to the gas container, it is necessary to form a hole at a pertinent part in the side wall of the casing cylinder corresponding to the location where the gas container is disposed, and the feed valve must be fitted into the gas container from this hole. If this method is used, the end face of the feed valve is exposed in the outer surface of the casing cylinder to impair the external appearance of the lighter, resulting in reduced commercial value of the article.

On the other hand, if it is tried to set the feed valve in the inconspicuous rear end of the casing cylinder, although the foregoing problem is somewhat alleviated, it becomes impossible to directly connect the feed valve and gas container as a high voltage generating means is disposed therebetween, and hence it is necessary to connect them by way of a pipe. This method, therefore, necessitates a space for accommodating the pipe in the casing cylinder, and this makes it necessary either to enlarge the diameter of the casing cylinder or to provide a passage for passing said pipe in the assembling parts of the high voltage generating means. However, the former way not only forms an unusual space in the casing but impairs carriage of the lighter, as it is enlarged in diameter while the latter method has the defect that the construction and the assembling of the parts is complicated and makes manufacturing troublesom and time-consuming because it is difficult to manufacture a small-sized pencil-shaped gas lighter by using small-sized assembling parts.

The present invention has for its object to provide a small-sized pencil-shaped gas lighter which is easy to operate and convenient to carry about and which is also not impaired in external apearance as it uses a casing cylinder assembly composed of a combination of separable fore and rear cylinders.

The invention, as well as other objects and advantages will be better understood from the following detailed description and the accompanying drawings, in which:

BRIEF DESCRIPTION OF THE DRAWINGS

FIG. 6 is an enlarged sectional view showing the interior arrangements in the fore cylinder of the lighter;

FIG. 7 is a plane view of a valve opening plate used in the lighter;

FIG. 8 is an enlarged sectional view of the portion of the lighter where the valve opening plate is mounted;

FIG. 29 is a modification of the high voltage generating means;

FIG. 30 is an enlarged sectional view showing the interior of the fore cylinder of a pencil-shaped gas lighter assembled by using the coupling shown in FIG. 17; and FIG. 31 is an enlarged cross-sectional view of a valve shaft in which is fitted a discharge needle used in said lighter.

DETAILED DESCRIPTION

Figure 4:
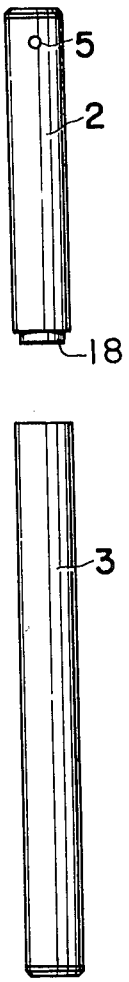
FIG. 4 is also a similar view but showing a condition where the fore and rear cylinders of the lighter have been separated.
Figure 5:
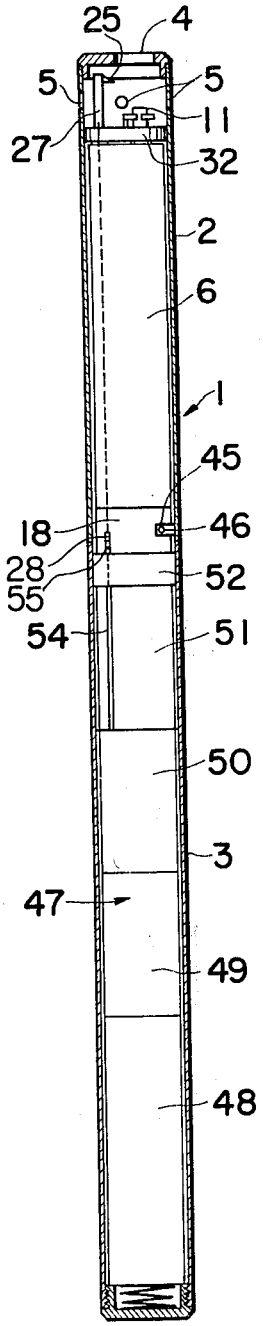
FIG. 5 is an enlarged side view of the lighter, with a part of the casing being cut out.
Figure 9:
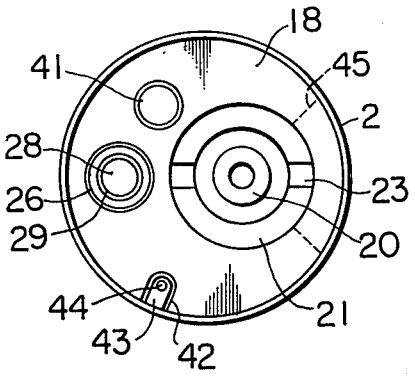
FIG. 9 is an enlarged rear end view of the fore cylinder.
Figure 10:
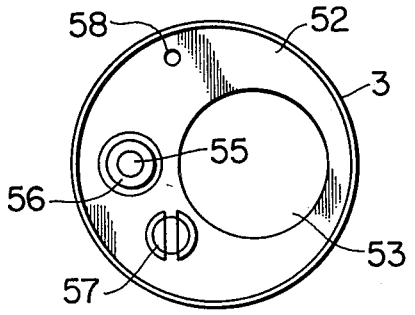
FIG. 10 is an enlarged front end view of the rear cylinder.

The lighter contemplated herein has a cylindrical casing 1 made from a small-sized small-diameter metallic cylinder assembly which is approximately 150 mm in total length and approximately 10 mm in outer diameter. This cylindrical casing 1 is composed of a combination of separable fore cylinder 2 and rear cylinder 3 as shown in FIG. 4. If desired, a clip may be attached to the casing 1. Reference numeral at an eccentric position in the end cap of the fore cylinder 2 is a flame port 4. An air vent 5 is provided at a part of the casing wall adjacent to the end of said fore cylinder 2 while a metal-made gas container 6 is slidably fitted in said fore cylinder 2. A front end plate 7 covers the front end of gas container 6. Said front end plate 7 is provided with an internal threaded hole 8 in which is threadedly engaged a cylinder 9 inserted into said gas container 6. Fitted in said cylinder 9 through a spring 13 is a hollow valve stem 12 which has at its fore end an ignition nozzle positioned immediately below flame port 4 and also has at its rear end a gas valve 10. A valve seat 14 provided at the rear end of cylinder 9 where said gas valve 10 makes contact, with a cylinder 15 being provided on the gas inlet side of said seat. A hollow piston 17 is fitted into said cylinder 15 through a pressure reducing packing 16, and a rear end plate 18 covers the rear end of the gas container 6. As shown in FIG. 4, the rear end of said rear end plate projects out slightly from the rear end joint of the fore cylinder 2 such that said protuberant portion can be fitted into the corresponding end of the rear cylinder 3. A valve box 21 is threadedly engaged in the internal threaded hole 19 formed in rear end plate 18. Provided in valve box 21 is a feed valve 20 for supplying gas into the gas container 6. A conduit 22 extends through the gas container 6, said conduit being connected at one end to hollow piston 17 and at the other end to the valve box 21 projecting into the gas container 6. The wall of conduit 22 is formed with pores 24 connecting into the gas container 6. When the conduit 22 is filled with the gas supplied from the feed valve 20, the gas flows out from said pores 24 into the gas container 6 to fill it up with the gas. At the rear end face of the valve box 21 is formed a groove 23 in which the driving tip of a driver or like means can be set. When the driving tip of a driver or such is set in said groove and then the driver is turned after separating the fore and rear cylinders 2 and 3, the pitch movement of the valve box 21 given by the threaded hole 19 is conveyed to the hollow piston 17 through the conduit 22 to adjust the compressibility of the pressure reducing packing 16 to thereby control the gas ejection from the ignition nozzle 11, that controls the size of the flames. Provided within the range of gas ejection from the ignition nozzle is a discharge electrode 25. This discharge electrode is secured to an insulating support pipe 27 fitted and fixed in the end opening of a pipe 26 which extends in the gas container 6 and which is secured to the front end plate 7 and rear end plate 18. Provided inside and toward the rear end of said pipe 26 is a current conducting terminal 28 which is elastically pressed by a spring provided in a casing 29 to project out from the rear end of said casing 29. A connecting rod 30 is passed in pipe 26 to connect discharge electrode 25 and current conducting terminal 28, by means of a lead wire 31. A circular valve opening plate 32, as shown in FIG. 7, is formed with a hole 33 for passing the valve stem 12, a hole 34 for passing the insulating support pipe 27 and holes 35, 35 for passing the return operating rods 38 which are to be described later. These parts projecting out from front end plate 7 are passed through these holes, and the peripheral edge of valve opening plate 32 is secured as by spot welding to the inner wall of the fore cylinder 2. The return operating rods 38, 38 are passed at one end through holes 35 formed in valve opening plate 32, with stopper rings 39, 39 being secured to the end portions just beyond these holes, while the other ends of these rods are fitted in the hole 36 formed in the front end plate 7, with springs 37 disposed therein. A stopper ring 40 is secured to the outer wall of the ignition nozzle 11 projecting out from the valve opening plate 32. When the fore cylinder 2 is pushed toward its front end side, the valve opening plate 32 presses the stopper ring 39 to raise up the return operating rods 38, 38 against the force of spring 37, while also raising up the valve stem 12 through stopper ring 40 to the gas valve 10 opening position against the force of spring 13. Whereby the gas valve 10 separates from the valve seat 14 to open the gas passage in valve seat 14, allowing the pressured gas in the gas container 6 to flow out from the conduit 22 to pass through the hollow of the piston 17, pressure reducing packing 16, the gas pressure in the valve seat 14, the hole formed in the wall of the valve stem 12 and then the hollow of valve stem 12 to finally eject out from the ignition nozzle 11. When the pressing force on the fore cylinder 2 is released, spring pressure accumulated in the spring 37 acts to the return operating rod 38 to return the valve opening plate 32 to its original position. The valve stem 12 also returns to its original position by receiving pressure of the spring 13 and the gas valve 10 now closes the gas passage in the valve seat 14.

Figure 1:
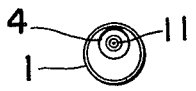
FIG. 1 is a top plan view of a pencil-shaped gas lighter according to the present invention.
Figure 2:
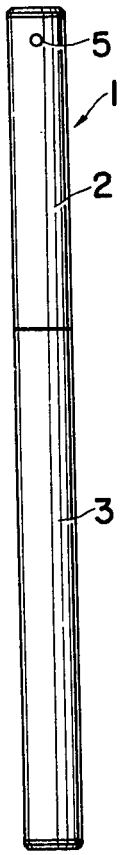
FIG. 2 is a side view of the same lighter in a condition where the flames have been just stifled.
Figure 3:
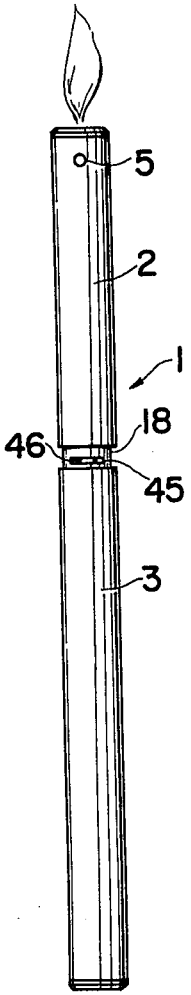
FIG. 3 is a similar view to FIG. 2 but showing a condition where the lighter is being ignited.

Formed in the rear end plate 18 is an engaging hole 41, with a suitable depth from the rear end face thereof, and formed in a part of the side wall of said rear end plate 18 is a slot 42 with a suitable length from the rear end face toward the end of the plate. Slidably fitted in said slot 42 is a protuberance 43 provided on the inner wall of the rear end joint of the fore cylinder 2, said protuberances 43 being provided with a hole 44 into which the end of a push lever 60 of a microswitch 51, which is to be described later, can be removably fitted. Also provided in the rear end plate 18 is a slot 45 such that it is elongated circumferentially at the location where the external surface of the plates approach closest to the valve box 21. This slot is provided at that part of the side face of the rear end plate 18 which is exposed between the spaced-apart joining ends of both fore and rear cylinders 2 and 3 when said fore cylinder 2 is pushed forwards to eject gas as shown in FIG. 3. It is possible to turn the valve box 21 without separating both fore and rear cylinders 2 and 3 as shown in FIG. 4, by inserting a pin or the like into one of the small holes provided at suitable intervals intervals in the external surface of the valve box 21 corresponding to said elongated slot 45, thus allowing adjustment of the rate of gas ejected from the ignition nozzle 11.

Figure 11:
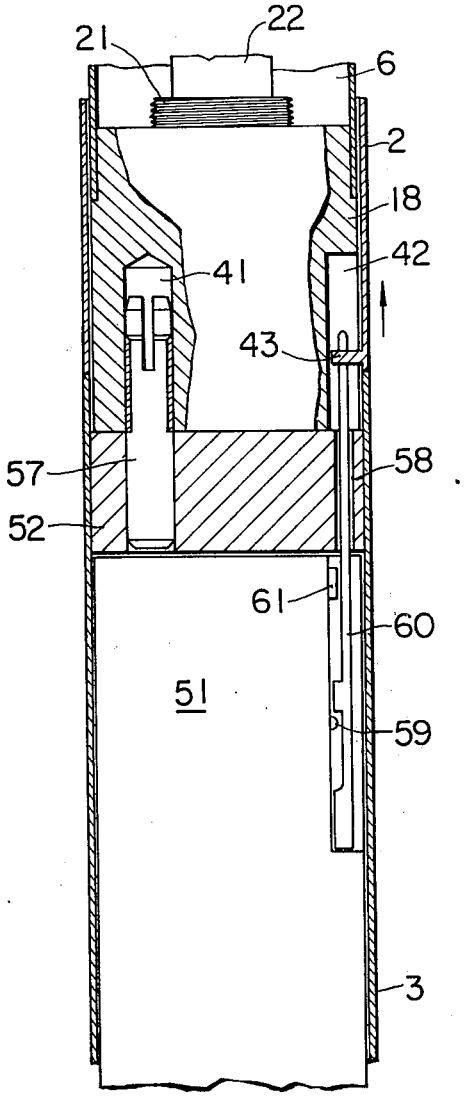
FIG. 11 is an enlarged sectional view of the juncture of the fore and rear cylinders.
Figure 12:
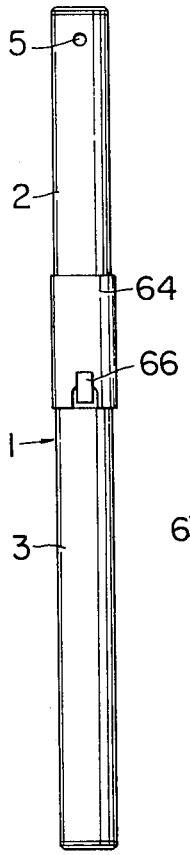
FIG. 12 is a side view of a pencil-shaped gas lighter according to another embodiment of the present invention.

The high voltage generating means 47 is provided in the rear cylinder 3. It comprises a charging circuit and a discharging circuit formed by a battery 48, a capacitor 49, a transformer 50 and a microswitch 51. The battery 48, if used up, can be exchanged with a new one by removing the rear end cap of the rear cylinder 3. A coupling 52 is secured to the inner wall of the rear cylinder 3 by spot welding at a position slightly recessed from the end face of the fore joint of the rear cylinder 3. It is provided with a hole 53 into which the protuberant portion of the valve box 21 can escape when the valve box 21 is turned to the position where it projects out from the rear end of the rear end plate 18 for adjusting the flames. Also, there is an insulating pipe 56 including a contactor 55 of which the fore end enters pipe 26 from the rear end opening to contact the terminal 28 while the rear end is electrically connected to the high voltage generating means 47 by way of a lead wire 54. Further, a protuberance 57 is removably fitted into the hole 41 provided in the rear end plate 18 as shown in FIG. 11, while there is also an aperture 58 through which a push lever of the microswitch 51 is passed, said push lever being described in detail later. The microswitch 51 has a push lobe 59 which pushes said lobe 59. One end of push lobe 59 is depressed, the charging circuit of the high voltage generating means is turned on to discharge the high voltage charged in the charging circuit. Of the thus discharged high voltage, the portion on the high voltage side is applied to the discharge electrode 25 through lead wire 54, contact terminal 55, conducting terminal 28 and lead wire 31, while the portion on the low voltage side is applied to the ignition nozzle 11 by passing through the respective parts from the earth terminal 101 (see FIG. 29) contacted with the inner wall of the rear cylinder 3, thus giving off discharge sparks between the discharge electrode 25 and ignition nozzle 11. These discharge sparks ignite the gas ejected from the ignition nozzle 11 which has been moved to the gas valve 10 open position by the valve opening plate 32 with pushed movement of the fore cylinder 2, and consequently the flames rise up from the flame port 4. A protuberance 61 is provided to prevent the push lever 60 from being forcibly pulled out when the fore cylinder 2 is pushed forward.

In this pencil type gas lighter, if the fore and rear cylinders 2 and 3 are pulled in the opposite directions, the protuberance 57 moves away from the hole 41 while the push lever 60 is also disengaged from the hole 44, so that both cylinders 2 and 3 separate from each other to bare out the feed valve 20 on the rear side of fore cylinder 2, thus allowing a supply of gas into the gas container 6. The separated fore and rear cylinders 2 and 3 can be joined together into one assembly as shown in FIG. 11 by pressing the protuberance 57 into the hole 41 while inserting the push lever 60 into the opening 44 through a hole 58.

Figure 13:
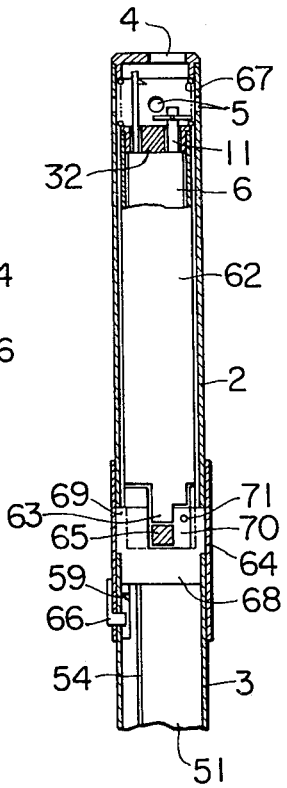
FIG. 13 is a partial enlarged sectional view of the same lighter.
Figure 14:
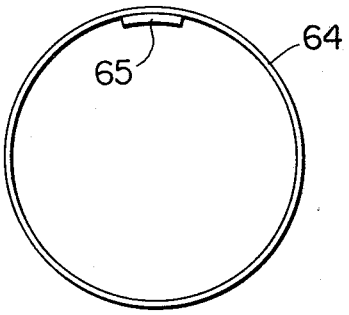
FIG. 14 is an enlarged end view of an ignition ring used in said lighter.
Figure 15:
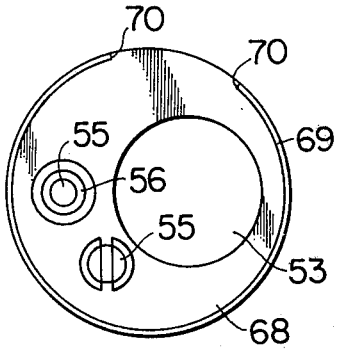
FIG. 15 is an enlarged end view of a coupling used in the lighter.
Figure 16:
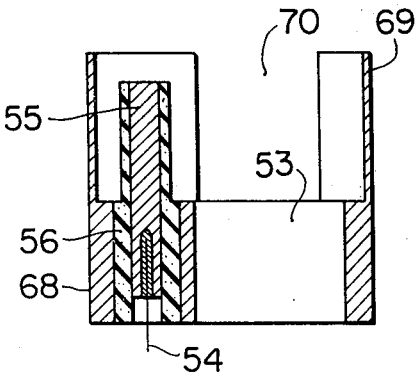
FIG. 16 is an enlarged sectional view of said coupling.
Figure 17:
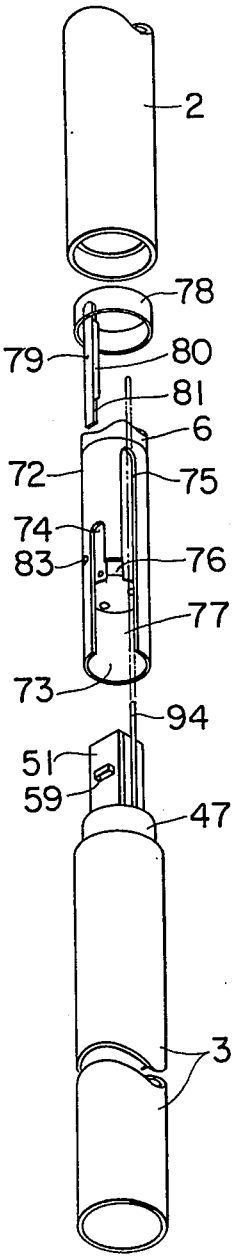
FIG. 17 is an enlarged exploded perspective view of the juncture of the fore and rear cylinders in a pencil-shaped gas lighter using a modified coupling.
Figure 18:
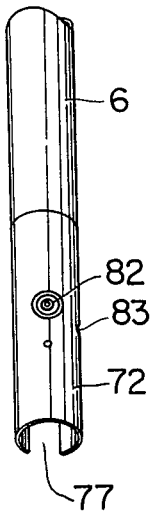
FIG. 18 is a perspective view of said coupling as taken from the side opposite to FIG. 17.

Referring now to FIGS. 12 to 16, there is shown another embodiment of the present invention. In this embodiment, a pipe 62 is slidably fitted between the fore cylinder 2 and gas container 6, with the valve opening plate 32 being secured to the front end of pipe 62. At the rear end of said pipe 62 a protuberance 63 is provided which extends out from a part of the pipe edge as shown in FIG. 13. Also, a ring 64 is slidably fitted around the joint of the fore and rear cylinders 2 and 3. This ring 64 has on its inner wall a protuberance 65 which extends through a hole (not shown) in the wall of the fore cylinder 2 and abuts against the protuberance 63 of pipe 62 to push against it. At the rear end of ring 64 a protuberance 66 is also provided adapted to depress the pressing lobe 59 of the microswitch 51 of the high voltage generating means 47. Thus, if the ring 64 is pushed toward the front end of the fore cylinder 2 instead of pushing the fore cylinder 2 itself, the protuberance 65 pushes the pipe 62 whereby the valve opening plate 32 secured to the end of pipe 62 pulls up the ignition nozzle 11 from the cylinder 9 to eject gas from the gas container 6 in the same way as in the preceding embodiment. Concident with this gas ejection, the protuberance 66 provided at the rear end of the ring 64 depresses the pushing lobe 59 of the microswitch 51 to discharge the high voltage charged in the charging circuit of the high voltage generating means to let out discharge sparks between the discharge electrode 25 and ignition nozzle 11, thereby igniting the gas ejected from the ignition nozzle 11.

In FIG. 13, reference numberal 67 designates a spring interposed between the end cap of the fore cylinder 2 and the valve opening plate 32. This spring plays the role of the return operating rods 38 in the preceding embodiment, that is, it acts to let the valve opening plate 32 return to its original position from the position where it has been pushed by the ring 64 through the pipe 62. A coupling 68 joins the separable fore and rear cylinders 2 and 3. Like the coupling 52 in the previous embodiment, it has a hole 53 into which the rear end of the valve box 21 can escape, an insulating pipe 56 containing a contact terminal 55, and a protuberance 57 which is removably fitted in the hole 41. An engaging ring 69 is provided integral with the coupling 68 and adapted to snagly receive therein the rear end plate 18 of the gas container 6 projecting from the rear joint of the fore cylinder 2. Provided at a portion of engaging ring 69 is a cut-out portion 70 arranged to allow extension therethrough of the protuberance 65 as well as movement of said protuberance to the position where it is placed off the protuberance 63, with turn of the ring 64. When the protuberance 65 is turned to the position off the protuberance 63, it abuts against a stopper protuberance 71 provided on the rear end plate 18 of the gas cylinder 6, so as to eliminate any possibility that the ring 64 be mistakenly or accidentally pushed to cause ignition when the gas lighter is not used.

Figure 19:
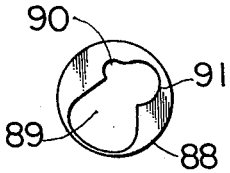
FIG. 19 is a plan view of a valve opening plate used in combination with said coupling.
Figure 20:
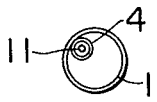
FIG. 20 is a top view of a pencil-shaped gas lighter using the coupling of FIG. 17, said lighter being shown in a condition where the flames have been stifled.
Figure 22:
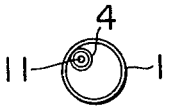
FIG. 22 is a top view of the same lighter in a condition where it is being clicked to flame.
Figure 21:
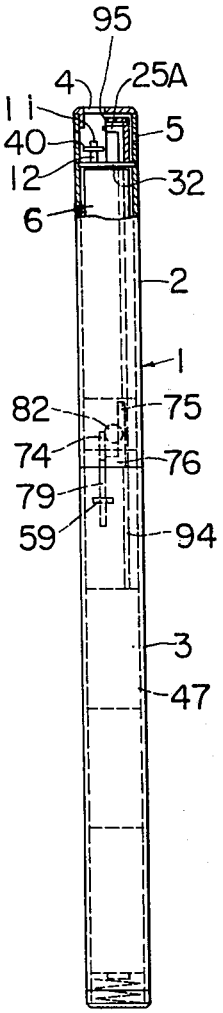
FIG. 21 is a partly cut-out side view of the gas lighter shown in FIG. 20.
Figure 23:
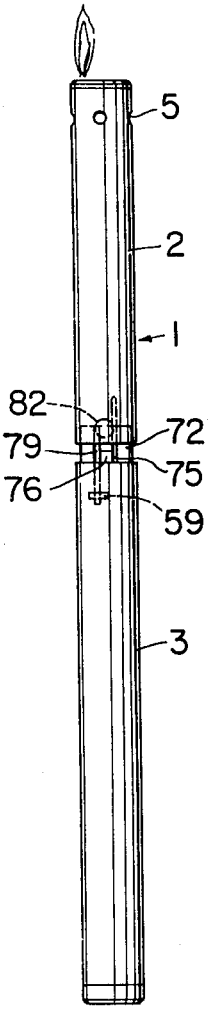
FIG. 23 is a side view thereof.

Referring now to FIGS. 17 to 25, there is shown still another embodiment of the coupling of the fore and rear cylinders 2 and 3 according to the present invention. Designated generally by numberal 72 is a coupling formed by extending the rear end plate 18 of the gas container 6 shown in the preceding embodiment. The portion of the coupling which fits on the joining end of the rear cylinder 3 is hollowed as shown by numberal 73 so that when the fore and rear cylinders 2 and 3 are joined together, the microswitch 51 of the high voltage generating means 47 housed in the rear cylinder 3 is placed in said hollow portion 73. In the side of the portion of said coupling 72 which is slidably fitted in the fore cylinder 2, there are provided a short slot 74 and a long slot 75 arranged axially of the fore cylinder 2 and disposed respectively at a part corresponding to the push lobe 59 of the microswitch 51 and a part spaced a certain angular distance therefrom. The short slot 74 is of a length which is suitable for the stroke of the valve opening plate 32 for pulling up the ignition nozzle 11 to the open position of the gas valve 10 when the fore cylinder 2 is slid. A connecting opening 76 is provided between the ends of both slots 74 and 75. An opening 71 is formed in the side wall portion of the coupling 72 covering the hollow portion 73 by cutting out the extension of the intermediate portion between said both slots 74 and 75, and a ring 78 slidably is fitted around the coupling 72 and fixed to the inner wall of the rear end joint of the fore cylinder 2. 79 is a lever which can fit slidably into either of slots 74 and 75, with one end of said lever being fixed to the ring 78. It is movable from one end to the other of the cutout portion 77 through the connecting opening 76 with a turn of the fore cylinder 2 so as to regulate the turn of said fore cylinder within to correspond to the distance between slots 74 and 75. Thus, this lever 79 plays the role of the push lever 60 in the preceding embodiment. That is, when the fore cylinder 2 is turned to the position of FIG. 20 to move the lever 79 to the short slot side, the intermediate thick portion 80 of the lever 79 rides on the push lobe 59 of the microswitch 51 as shown in FIG. 21 to depress said lobe 59 to switch on the charging circuit of the high voltage generating means 47, thus charging the high voltage to the charging circuit. Then, when the fore cylinder 2 is pushed to slide the lever 79 along the short slot 74 as shown in FIG. 23, the thin portion 81 at the rear end of the lever 79 arrives on the push lobe 59 of the microswitch 51 as shown in FIG. 23 to release pressure by the thick portion 80 to now switch on the discharging circuit of the high voltage generating means, whereupon the high voltage charged to the charging circuit is conducted to the discharge electrode 25 to produce discharge sparks between the gas valve 10 and ignition nozzle 11 which has been raised up to the open position of the gas valve by the valve opening plate with pushed movement of the fore cylinder 2 and is ejecting gas, so as to ignite the gas from the ignition nozzle to create flames. The flames spout out from the flame port 4 which has moved just over the ignition nozzle 11 when the fore cylinder 2 has turned to the position of FIG. 20. Under this condition, if pressure on the fore cylinder 2 is released, the fore cylinder 2 automatically returns to the original position through the valve opening plate 32 by the action of the return operating rods 38 and at the same time the gas valve 10 is closed to stifle the flames.

Figure 24:
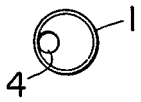
FIG. 24 is a top view of the same lighter with the feed valve and flame adjusting portion being exposed.

When the fore cylinder 2 is turned to the position of FIG. 24, the lever 79 separates from the push lobe 59 of the microswitch 51 and moves to the long slot side while the flame port 4 moves to the position off the ignition nozzle 11, and the open end of the ignition nozzle 11 is covered by the end cap of the fore cylinder 2 to guard the ignition nozzle 11 against dust or other alien matters when the gas lighter is not in use.

Figure 25:
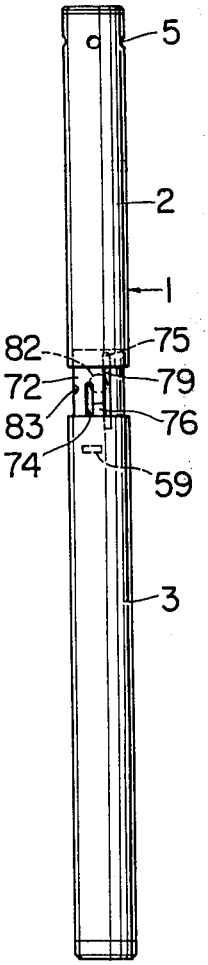
FIG. 25 is a side view thereof.

If the fore cylinder 2 is pushed at the position of FIG. 24, the lever 79 slides along the slot 75 to move the fore cylinder 2 forward through the length of said slot 75, whereupon the joined ends of the fore and rear cylinders 2 and 3 separate from each other as shown in FIG. 25 to bare the side face of the coupling 72. It is to be noted that a feed valve 82 communicated with the gas container 6 and a flame adjusting portion 83 against dust or external impact.

Flame adjusting portion 83 has the following construction. That is, as shown in FIG. 30, the conduit 22, which is connected at one end to the hollow piston 17 slidably fitted through pressure reducing packing 16 in the cylinder 15 provided on the gas inlet side of the valve seat 14, is provided with a threaded bolt 84 at the other end, and this threaded bolt 84 is inserted into a hole 85 formed in the rear end plate 18 of the gas container, and a nut 87 threadedly engaged with said bolt 84 is fitted in a hole 86 formed so as to open in one side surface of the rear end plate 18 from said insertion hole 85. Thus, the user can adjust the amount of gas ejected from the ignition nozzle 11 by turning the nut 87 to let the conduit 22 make vertical pitch movement while placing a finger against the side of the nut 87 close to the opening of the hole 86 to adjust compression of the pressure reducing packing 16. Arrangement is also made such that when gas which is ejected from the ignition nozzle 11 is ignited by pushing the fore cylinder 2 after turning it toward the short slot 74 in the coupling 72, the flame adjusting portion 83 emerges on the side of the coupling 72 to allow adjustment of the size of the flames when ignition is effected.

FIG. 19 shows a valve opening plate designed for use in combination with coupling 72. It comprises a disc 88 fixed to the inner wall of the fore cylinder 2 and arranged rotatable with the rotation of the fore cylinder 2, said disc being provided with an opening 89 formed by enlarging the hole 33 in the valve opening plate 32 for passing the valve shaft 12 and the hole 34 for passing the insulating support pipe 27 in the preceding embodiment in conformity to the range in which the fore cylinder 2 is movable between the short and long slots 74 and 75 in the coupling 72. Said opening 89 is provided with an engaging edge 90 designed to engage with the stopper ring 40 provided at the outer periphery of the ignition nozzle 11 to raise up the ignition nozzle 11 to the open position of the gas valve 10 when the fore cylinder 2 is turned toward the short slot 74 as shown in FIG. 20 and then pushed toward its front end as shown in FIG. 23, and a disengaging edge 91 designed to release engagement with stopper ring 40 of the ignition nozzle 11 when the fore cylinder 2 is turned toward the long slot 75 as shown in FIG. 24 and then pushed toward its front end as shown in FIG. 25.

Figure 26:
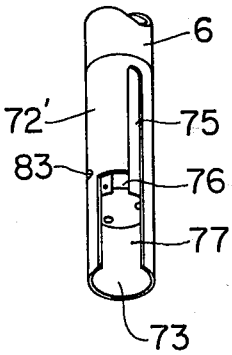
FIG. 26 is an enlarged perspective view of a modification of the coupling shown in FIG. 26.

FIG. 26 shows a modification of the coupling 72. This modified coupling 72′ lacks the short slot 74 in the coupling 72, but is otherwise the same as said coupling 72.

In case of using this coupling 72′, arrangement is made so that when the fore cylinder 2 is turned opposite to the elongated slot 75 and the lever 79 depresses the push lobe 59 of the microswitch 51 of the high voltage generating means 47, the charging circuit is energized while the discharging circuit deenergized, and when the fore cylinder 2 is turned toward the slot 75 and the lever 49 is disengaged from the push lobe 59, the charging circuit is energized while the discharging circuit deenergized.

Figure 27:
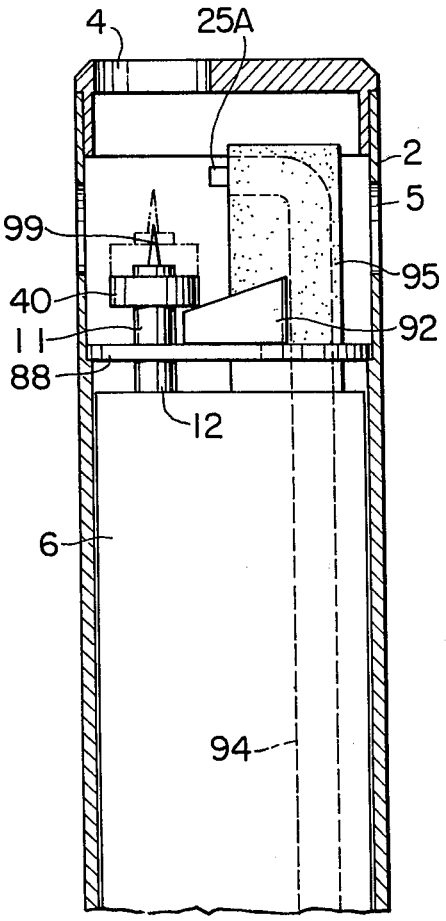
FIG. 27 is an enlarged sectional view showing a method of setting a valve opening plate used in combination with the coupling of FIG. 26.
Figure 28:
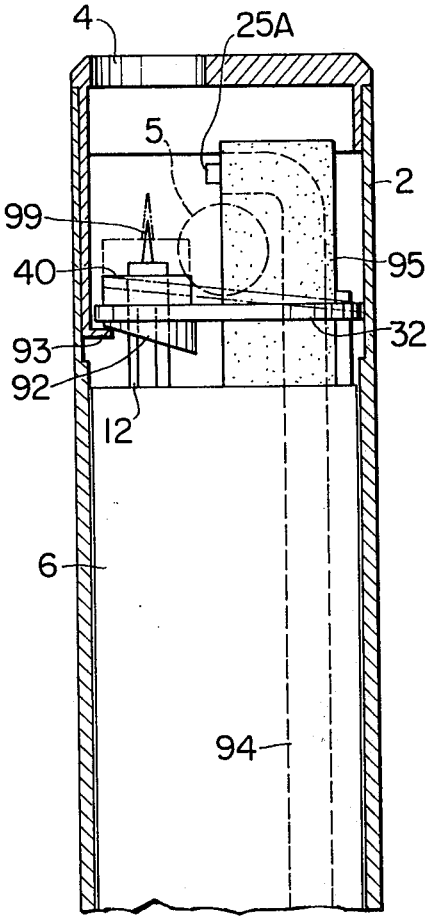
FIG. 28 is an enlarged sectional view showing another method of setting said plate.

In case of using the coupling 72′, if no gas is ejected from the ignition nozzle 11 when the fore cylinder 2 is turned in the direction opposite to the slot 75, no ignition is made, so that a cam 92 is provided at an upper end of the valve opening plate 88 as shown in FIG. 27 or at the undersige of the valve opening plate 32 as shown in FIG. 28 such that cam 92 will act on the stopper ring 40 on the ignition nozzle 11 with the turn of the fore cylinder 2 to raise up the ignition nozzle 11 to the open position of the gas valve 10. In the case of the embodiment shown in FIG. 27, the valve opening plate 88 turns together with the fore cylinder 2 to push up the stopper ring 40 along the incline of the cam 92 to thereby open the valve.

In the case of FIG. 28, the portion of the valve opening plate 32 remote from the ignition nozzle 11 is fixed while the portion close to the ignition nozzle 11 acts as a free end loaded with a spring pressure and abutting against the underside of the stopper ring 40, and the end of a hook bar 93 turning with the fore cylinder 2 abuts against the incline of the cam 92 provided on the underside of the free end to raise up the valve opening plate 88 against its spring pressure to thereby open the valve.

FIG. 29 shows a partial modification of the high voltage generating means already described. In this modification, a capacitor 49A, a transformer 50A and a microswitch 51A, all with a size conforming to the hollow of the rear cylinder 3 are joined in vertical alignment and wired so that the charging and discharging circuits can be switched from one to the other by the push lobe 59A of the microswitch 51A. These three parts are covered with an organic insulation material such as plastic to form an integral assembly. In FIG. 29, numeral 101 is a ground terminal which extends out so that it will touch the inner wall of the rear cylinder 3 when said integral assembly of the three parts is placed in the rear cylinder 3 along with a battery, and 94 is a lead wire which extends along from a side of the microswitch 49A and is coated with an insulating material. This lead wire 94 is so arranged that, as shown in FIG. 30, when the fore and rear cylinders 2 and 3 are joined together, it extends out from the rear end plate 18 of the gas container 6, passes the inside of said gas container, pierces through the fore end plate 7 and further passes through the valve opening plate 32 or 88 to reach a position close to the ignition nozzle 11 to form a discharge electrode 25A. An insulating support member 95 for said lead wire 94 passes through the valve opening plate 32 or 88 and lead wire 94 is enclosed with a pipe 96 that passes through the gas container 6. As shown in FIG. 30, both ends of said pipe 96 are secured to the fore end plate 7 and rear end plate 18, of the gas container to prevent gas leak.

If the high voltage generating means is used, the parts such as current conducting terminal 28 and contactor 55 provided on the lead wire are not necessary which makes the construction simple and the assemblage easy. Also, since portions of the lighter through which the lead wire passes are provided in the fore cylinder 2, the required space is diminished to allow reduction of the size of the cylinder assembly 1.

In FIG. 30, an externally threaded portion 97 is provided at the end of the ignition nozzle 11, with the stopper ring 40A being threadedly fitted on said portion. It is possible to quicken, or slow down, the opening time of the gas valve 10 by the valve opening plate 32 or 88 so that such valve opening coincides with the emission of the discharge sparks from the discharge electrode 25 by moving stopper ring 40A in pitches by said threaded portion 97 to adjust the distance between said stopper ring and the valve opening plate 32 or 88. An air vent 98 is provided for letting out the air amassed in the gas container 6 when gas is supplied into said gas container through the feed valve 82. Inserted into the top end of the ignition nozzle 11 is a discharge needle 99 so that the pointed end of said needle 99 projects out from the end of the ignition nozzle 11. In the portion of said needle 99 inserted into the ignition nozzle 11 is provided a space 100 defined by a portion of the inner wall of the ignition nozzle 11 for allowing passage of gas therethrough as shown in FIG. 31. If no such discharge needle 99 is provided in the ignition nozzle 11, the ignition rate may be reduced as many discharge sparks are produced between the discharge electrode 25 and the portion of the ignition nozzle positioned close to said electrode while there are less discharge sparks which fly across the gas ejection from the end of the ignition nozzle 11. If said discharge needle 99 is provided in the ignition nozzle 11, the discharge sparks flying across the gas flow from the ignition nozzle end are increased to greatly improve the ignition rate.

As described above, according to the device of the present invention, which has been just described above concerning its arrangements, it is possible to accomplish ignition, stifling of flames as will as exposure and concealment of the flame adjusint portion and feed valve by a simple operation of merely pushing or turning the fore cylinder of the device. Also, since the feed valve and other internal parts are covered up within the casing, the external appearance of the device is not impaired and also the feed valve is protected against external impact. Further, since the feed valve is secured directly to the gas container, the required space can be minimized, thus realizing an ideal pencil-shaped gas lighter which is small in size and very handy to carry.

I claim:

1. In a pencil type gas lighter having:

a. a cylindrical casing (1) consisting of a fore cylinder (2) provided with a flame port (4) at the front end and a rear cylinder (3) separately joined with said fore cylinder;

b. a gas container (6) in said fore cylinder housing, an ignition nozzle with a gas valve (10) disposed on the fore cylinder front end side of said gas container in communication with said gas container through said gas valve (19);

c. a discharge electrode (25) positioned within the range of gas ejection from the ignition nozzle, and a feed valve disposed on the fore cylinder rear end side of said gas container for supplying gas into said gas container; with, d. a high voltage generating means (47) in said rear cylinder, electrically connected to said discharge electrode (25), said high voltage generating means having a valve opening member (32) and a lever, said valve opening member (32) being adapted for opening the gas valve in cooperation with the lever operable to generate a high voltage in said high voltage generating means; the improvement therein, wherein the ignition nozzle is provided at the front end of a hollow valve shaft the rear end of which is connected to the gas valve provided in the gas container, and a coupling is provided at the rear end of the gas container, said gas container being slidably fitted into said fore cylinder, said coupling of the gas container being separably joined to the counterpart provided in the inside of the joining end of the rear cylinder, said fore cylinder being provided at its rear end with said lever adapted to act on the high voltage generating means during sliding movement of said fore cylinder to generate a high voltage and also provided to move the ignition nozzle to the open position of the gas valve when said fore cylinder slides forwards.

2. A pencil type gas lighter according to claim 1 wherein a pipe is provided extending through the gas container, said pipe having therein a current conducting terminal electrically connected to the discharge electrode, and wherein the coupling disposed at the joining end of the rear cylinder is provided with a contactor contacted with said terminal, said contactor having one end electrically connected to the high voltage generating means and having the other end inserted into said pipe.

3. A pencil type gas lighter according to claim 1 wherein a valve box is threadedly fitted into the gas container from the rear end of the coupling provided at the rear end of the gas container, said valve box being provided with a feed valve for supplying gas into said gas container, and wherein a cylinder housing a pressure reducing packing is provided on the gas inlet side of the gas valve, with one end of a hollow piston being fitted into said cylinder and a conduit having a hole communicating with the inside of said gas container connecting the other end of said hollow piston and the end of said valve box inserted into said gas container.

4. A pencil type gas lighter according to claim 1, further including spring means acting to automatically open the gas valve when the pushing force on the for cylinder is released, and means for automatically returning said fore cylinder and valve opening member to the closed position of the gas valve.

5. A pencil type gas lighter according to claim 1, wherein the valve opening member is provided with holes through which the valve shaft projecting from the front end of the gas container and connected to the ignition nozzle and the support of the discharge electrode are passed respectively, said valve opening plate being secured to the inner wall of the front end of the fore cylinder, and a stopper ring is provided around the front end of the ignition nozzle such that when the fore cylinder slides, the valve opening plate abuts against said stopper ring to raise the ignition nozzle to the open position of the gas valve.

6. A pencil type gas lighter according to claim 3, wherein a flame adjusting hole is provided in the side surface of the coupling which is exposed when the fore cylinder slides, said flame adjusting hole being designed to adjust compressibility of the pressure reducing packing by turning the valve box which houses a feed valve therein.

7. A pencil type gas lighter according to claim 1, wherein a pipe member is slidably fitted between the fore cylinder and the gas container, with a valve opening member being secured to the end of said pipe member, and an ignition ring is slidably fitted around the joint of the fore and rear cylinders, said ignition cylinder being provided on its interior surface with a protuberance which passes through the openings provided in said fore and rear cylinders to abut against the rear end of said pipe member and which forces the pipe member to slide with sliding movement of said ignition ring to actuate the valve opening member to open the gas valve.

8. A pencil type gas lighter according to claim 1, wherein two slots arranged axially on the fore cylinder are provided at a position corresponding to the switch portion of the high voltage generating means and at a position spaced a certain angle from said switch portion position, both positions being situated on the side surface of the coupling provided at the rear end of the gas container, both slots being connected by a connecting opening and a lever provided at the rear end of the fore cylinder, said lever passing in said connecting opening to move into either of said slots and slidable along either of said slots, said lever being also provided with a switch pressing lobe which depresses the switch of the high voltage generating means to conduct a high voltage to the discharge electrode when said lever is moved to the position corresponding to the switch portion of the high voltage generating means and slides into either of said slots.

9. A pencil type gas lighter according to claim 8, wherein a feed valve for supplying gas into the gas container and a flame adjusting portion are provided on the side face of the coupling which is bared when the fore cylinder slides forward.

10. A pencil type gas lighter according to claim 8, wherein the valve opening plate is provided with an opening formed by enlarging the hole for passing the valve shaft having the ignition nozzle and the hole for passing the support of the discharge electrode in conformity to the range of turn of the fore cylinder equivalent to the distance between both said slots in said coupling, said opening being provided with an engaging edge which engages with the ignition nozzle to open the gas valve when the fore cylinder is turned toward the slot associated with the switch of the high voltage generating means, and a disengaging edge which releases the engagement with the ignition nozzle when the fore cylinder is turned in the opposite direction from said position of turn.

11. A pencil type gas lighter according to claim 8, including a lever having a switch pushing lobe which pushes the switch of the high voltage generating means to conduct a high voltage to the discharge electrode when said lever is moved, and a valve opening member having a cam for moving the ignition nozzle to the gas valve opening position.

12. A pencil type gas lighter according to claim 1, wherein a high voltage lead wire extends out from the high voltage generating means is passed through the inside of the gas container and the valve opening member to reach a position close to the ignition nozzle so as to form a discharge electrode.

13. A pencil type gas lighter according to claim 1, wherein a stopper ring adapted to engage with the valve opening member is fitted around the fore end of the ignition nozzle.

14. A pencil type gas lighter according to claim 1, wherein a discharge needle is set in the ignition nozzle.

15. A pencil type gas lighter according to claim 8, wherein a flame port is provided at an eccentric position in the end cap of the fore cylinder, said flame port being turnable with turn of the fore cylinder to move to the position corresponding to the ignition nozzle when flame is produced.

* * * * *